US006997721B2

(12) United States Patent
Shirota

(10) Patent No.: US 6,997,721 B2
(45) Date of Patent: Feb. 14, 2006

(54) ELECTRICAL JUNCTION BOX

(75) Inventor: Toshiya Shirota, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/930,791

(22) Filed: Sep. 1, 2004

(65) Prior Publication Data

US 2005/0048813 A1 Mar. 3, 2005

(30) Foreign Application Priority Data

Sep. 2, 2003 (JP) ..... 2003-310316

(51) Int. Cl.
*H01R 12/00* (2006.01)

(52) U.S. Cl. ..... 439/76.2; 439/949

(58) Field of Classification Search ..... 439/76.2, 439/721, 723, 724, 715, 717, 949, 188, 417, 439/209, 211, 685

See application file for complete search history.

(56) References Cited

U.S. PATENT DOCUMENTS

| | | | | |
|---|---|---|---|---|
| 4,429,943 A | | 2/1984 | Inoue | |
| 4,453,799 A | | 6/1984 | Inoue | |
| 5,007,888 A | * | 4/1991 | Goutiere | 439/189 |
| 5,474,468 A | | 12/1995 | Chishima et al. | |
| 5,782,652 A | * | 7/1998 | Feher et al. | 439/417 |
| 6,375,490 B1 | * | 4/2002 | Yao | 439/417 |
| 6,712,623 B1 | | 3/2004 | Sumida | |
| 6,840,820 B1 | * | 1/2005 | Oda | 439/724 |
| 6,875,030 B1 | * | 4/2005 | Oda et al. | 439/76.2 |
| 2004/0033731 A1 | | 2/2004 | Oda | |
| 2004/0058570 A1 | | 3/2004 | Oda et al. | |

FOREIGN PATENT DOCUMENTS

| | | |
|---|---|---|
| JP | 57-85514 | 5/1982 |

* cited by examiner

*Primary Examiner*—P. Austin Bradley
*Assistant Examiner*—Edwin A. Leon
(74) *Attorney, Agent, or Firm*—Greenblum & Bernstein, P.L.C.

(57) ABSTRACT

An electrical junction box that improves the reliability of the electrical connections formed therein by avoiding of damage to the fork shaped terminals in the connector block by preventing the invasion of foreign objects. A shutter cover is located along the front and rear walls of the connector block to expose and cover slits which are formed at specific intervals on front and rear walls of the connector block. The shutter cover is constructed from two comb shaped side members having alternating open portions and solid portions, and a connecting portion that joins one edge of each side member. The shutter cover is attached at a position where solid portions cover the slits of the connector block before the connector block is inserted into the connector receptacle of the upper case. The complete insertion of the connector block into the connector receptacle results in the shutter cover moving to a position that aligns open portions to the slits, thus allowing the insertion of busbars into the slits.

12 Claims, 12 Drawing Sheets

ELECTRICAL JUNCTION BOX

BACKGROUND OF THE INVENTION

1. Field of the Invention

The present invention relates to an electrical junction box, and more particularly to an electrical junction box having vertically oriented busbars provided in a case and tuning fork shaped terminals inside a connector block that is inserted into the case, with the connector block constructed to protect the tuning fork shaped terminals until the connector block is inserted into the case.

2. Description of the Background Information

A known electrical junction box or branch wire connecting box of the type that provides a junction for branch wires of a vehicle wiring harness is shown as electrical junction box 1 in FIG. 12A. This junction box is disclosed in Japanese Laid Open Patent S57-85514. Electrical junction box 1 includes elongated planar vertically oriented busbars 3 arranged in parallel within case 2. Tuning fork shaped terminals 5, to which electrical wire ends are attached, are inserted and locked within connector block 4 through connector receptacle 2*a*, connector block 4 oriented lengthwise across busbars 3. Tuning fork shaped terminals 5 fit over busbars 3 when connector block 4 is inserted into connector receptacle 2*a*. Slits 4*a* are formed at specific intervals on both sidewalls of connector block 4 which fits into connector receptacle 2*a* of case 2, as shown in FIG. 12B, to allow the insertion of busbars 3 therein at locations corresponding to pressure contact slots 5*a* of tuning fork shaped terminals 5 which are secured within connector block 4.

Because slits 4*a* in connector block 4 are open to the external environment, foreign objects, such as electrical wires and the like, may easily enter connector block 3 through slits 4*a* when connector block 4 is inserted into connector receptacle 2*a* of case 2 of the electrical junction box. These foreign objects pose the threat of deforming and damaging tuning fork-shaped terminals 5, thus preventing their insertion over busbars 3, or preventing terminals 5 from sufficiently contacting bus bars 3. Further, the busbars may also be damaged if foreign objects are present.

SUMMARY OF THE INVENTION

The present invention was developed to overcome the above noted shortcomings in the prior art, and improves the reliability of the electrical connections within the junction box by preventing the invasion of foreign objects into the connector block, through the slits, when the connector block is inserted into the connector receptacle of the electrical junction box, thus preventing damage to the tuning fork shaped terminals inside the connector block.

An aspect of the present invention provides an electrical junction box including a plurality of planar busbars aligned in parallel within a case; a connector receptacle extending across the aligned busbars in the case; a connector block including slits formed at intervals along sidewalls thereof, the connector block configured to fit into the connector receptacle; a plurality of fork shaped terminals connected to ends of electrical wires, the fork shaped terminals secured within terminal chambers in the connector block, the fork shaped terminals fitting over the busbars when the connector block is inserted into the connector receptacle; and a shutter cover configured to expose or cover the slits of the connector block. In a further aspect of the present invention, the shutter cover is movable between a position covering the slits of the connector block and a position exposing the slits of the connector block. Further, the shutter cover is configured in a comb like construction with alternating open and solid portions on side members thereof and a connecting portion that joins an end of each side member. In a further aspect of the present invention, the shutter cover is attached to a portion of the connector block where the slits are provided, the shutter cover movable between a position in which the slits of the connector block are covered by the solid portion of the shutter cover and a position aligning the open portions of the shutter cover with the slits so that the busbars may enter the slits without obstruction when the connector block is inserted into the connector receptacle of the case.

In a further aspect of the present invention, each comb like side member of the shutter cover is provided in sliding contact with inside surfaces of the connector block sidewalls; the connecting portion is exposed as an external surface with the shutter cover temporarily secured to the connector block; and the connector receptacle including inclined ribs projecting therein and configured to exert pressure on the connecting portion to move the shutter cover to a position aligning the open portions of the shutter cover with the slits when the connector block is inserted into the connector receptacle. Further, each comb like side member of the shutter cover is provided in sliding contact with outside surfaces of the connector block sidewalls; the connecting portion is exposed as an external surface with the shutter cover temporarily secured to the connector block; and the connector receptacle including inclined ribs projecting therein and configured to exert pressure on the connecting portion to move the shutter cover to a position aligning the open portions of the shutter cover with the slits when the connector block is inserted into the connector receptacle.

An aspect of the present invention provides connector block including slits formed at intervals along sidewalls thereof, and configured to fit into a connector receptacle on an electrical junction box; a plurality of fork shaped terminals connected to ends of electrical wires, the fork shaped terminals secured within terminal chambers in the connector block, the fork shaped terminals fitting over busbars in the electrical junction box when the connector block is inserted into a connector receptacle; and a shutter cover configured to expose or cover the slits of the connector block.

Because the slits in the connector block are covered by the solid portions of the shutter cover when the connector block is inserted into the connector receptacle of the electrical junction box, the invasion of foreign objects, such as electrical wires and the like, is prevented, thus improving the reliability of the electrical connection by preventing damage to the tuning fork-shaped terminals in the connector block. Further, the connector block is inserted into the connector receptacle of the case with the shutter cover attached. The covered connector block slits become exposed due to the movement of the shutter cover when the connector block is inserted into the connector receptacle. Therefore, it is not necessary to detach the shutter cover from the connector block when the connector block is inserted into the connector receptacle.

The electrical junction box is preferably constructed so that both side members of the shutter cover have a comb-like structure maintained in sliding contact with the internal or external surfaces of both sidewalls of the connector block. The connecting portion, which is exposed as an external surface, is temporarily secured to the connector block when the connector block is inserted into the connector receptacle. Inclined ribs, which project into the connector receptacle, exert pressure on the connecting portion to move the shutter the required distance during the insertion process.

When the connector block is inserted into the connector receptacle of the case, the shutter cover, which is slidably attached to the connector block, comes into contact with the inclined ribs in the connector receptacle, the contact resulting in the shutter cover automatically being displaced the required distance to expose the slits in the connector block. This mechanism eliminates the need for the operator to move the shutter cover manually, thus allowing the connector block to be easily inserted into the connector receptacle of the case.

As noted, the connector block is initially inserted into the connector receptacle of the case with the connector block slits, which expose the fork shaped terminals, covered by the solid portions of the shutter cover. This prevents the invasion of foreign objects, such as electrical wires and the like, from entering the connector block, thus preventing damage to the fork terminals in the connector block and improving the reliability of the electrical connection.

The shutter cover, which is attached to the connector block, will move to a position that exposes the slits when the connector block is further inserted into the connector receptacle of the case. Therefore, the connector block can be inserted into the connector receptacle of the case with the shutter cover attached to the connector block, thus eliminating the need to detach the shutter cover from the connector block when inserted into the connector receptacle.

Moreover, inserting the connector block into the connector receptacle results in the inclined ribs pressing against the shutter cover, which is temporarily secured to the connector block, thus displacing the shutter cover to the extent that exposes the slits in the connector block, eliminating the need for the operator to move the shutter cover manually, and simplifying insertion operation.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

Figure 1A:
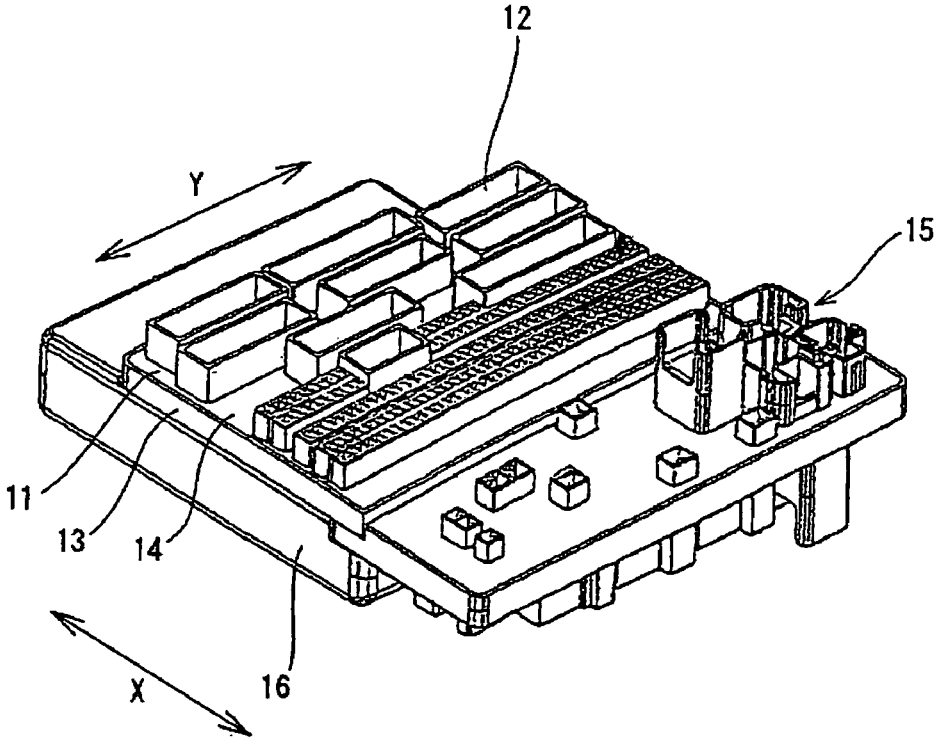
FIG. 1A is a perspective view of the electrical junction box of an embodiment of the present invention, before the connector block is inserted.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following describes embodiments of the present invention with reference to the attached drawings.

FIGS. 1 through 8 describe the first embodiment of the present invention. As shown in FIGS. 1A and 1B, electrical junction box 10 is constructed so that the insertion of connector block 20 into connector receptacle 12 of upper case 11 results in fork terminals 30, which hold the ends of electrical wires within connector block 20, fitting over busbars 40 which are housed in a case formed from upper case 11 and lower case 13. An electrical connection is thus made between busbars 40 and electrical wires 'W' through fork terminals 30. Further, FIG. 1A illustrates base module 14, fuse relay module 15, and ECU case 16.

The construction of connector block 20 is described in FIGS. 2 and 3A–3E. Terminal chambers 22, which are defined by divider walls 20*a*, are arranged in a row. Each terminal chamber 22 includes an upper terminal insertion opening 22*a* through which fork terminal 30, which is connected to the end of electrical wires, is inserted and secured. Slits 23 are formed at mutually opposing positions at right angles to the lower lengthwise edge of front and rear sidewalls 20*b*. Each slit 23 is located at the approximate mid-point of the respective terminal chamber 22.

With connector block 20 inserted into connector receptacle 12, terminal chamber 22 is located across busbars 40 which are held in parallel alignment within case 11. This construction allows each busbar 40 to align with an opposing pair of slits 23 formed in the front and rear sidewalls with the tines of each fork terminal 30 press fitting over the top portion of the opposing busbar 40.

Shutter insertion slots 20*e* are formed at the bottom and along both sides of connector block 20 at right sidewall 20*d* (shown in FIG. 3B) in order to provide space for the insertion of the shutter cover. Front and rear spaces 'S' are formed as recesses extending from the bottom portion of divider wall 20*a* which connects front and rear sidewalls 20*b*. Each side member 25 of shutter cover 24 is inserted into a corresponding space 'S'. Shutter cover 24 is maintained within spaces 'S' by the shutter support wall 20*f* that projects from the bottom edge of front and rear sidewalls 20*b* of connector block 20, sidewalls 20*b* being the solid portions of the connector block sidewalls bordering slits 23.

Figure 3A:
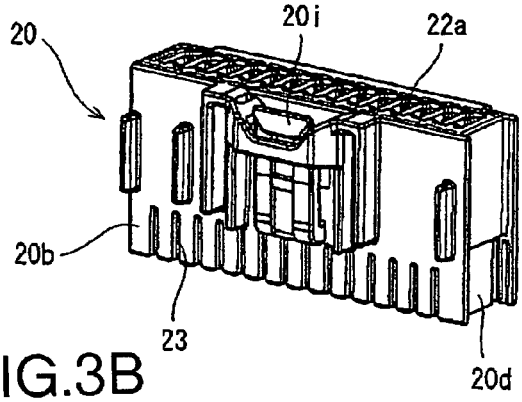
FIG. 3A is a perspective view of a connector block of a first embodiment of the present invention.
Figure 3B:
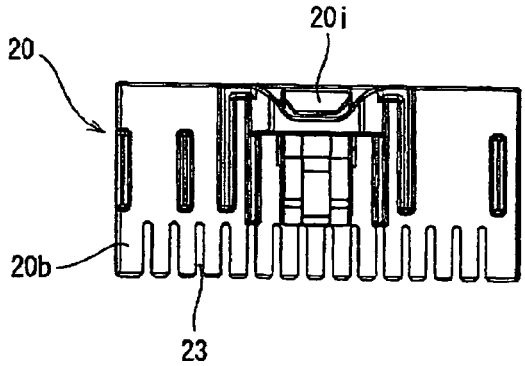
FIG. 3B is a front view of the connector block of the embodiment of FIG. 3A.
Figure 3C:
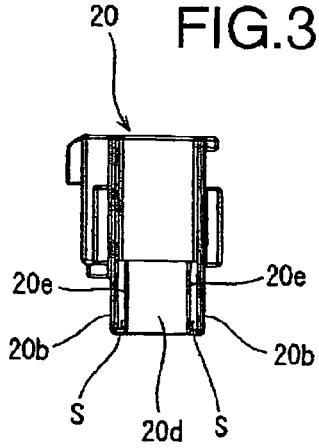
FIG. 3C is a right side elevational view of the connector block of the embodiment of FIG. 3A.
Figure 3D:
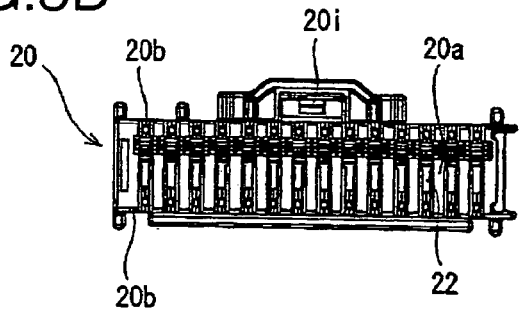
FIG. 3D is a bottom view of the connector block of the embodiment of FIG. 3A.
Figure 3E:
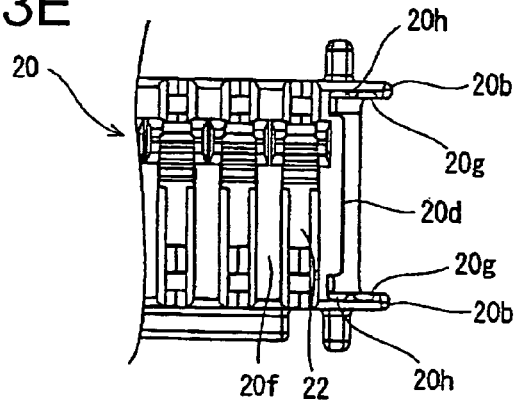
FIG. 3E is an enlarged bottom view of a portion of the connector block of the embodiment of FIG. 3A.

As shown in FIG. 3E, disconnection holding notch 20*g* and connection holding notch 20*h* are formed at outer and inner locations, respectively, on the shutter cover insertion side of connector block 20. Disconnection holding notch 20*g* is provided outboard of right side wall 20*d*, and connection holding notch 20*h* is provided inboard at the required distance from disconnection holding notch 20*g*. Further, lock portion 20*i* is provided on the external surface of one side of front and rear sidewalls 20*b* in order to secure connector block 20 within connector receptacle 12.

Figure 4A:
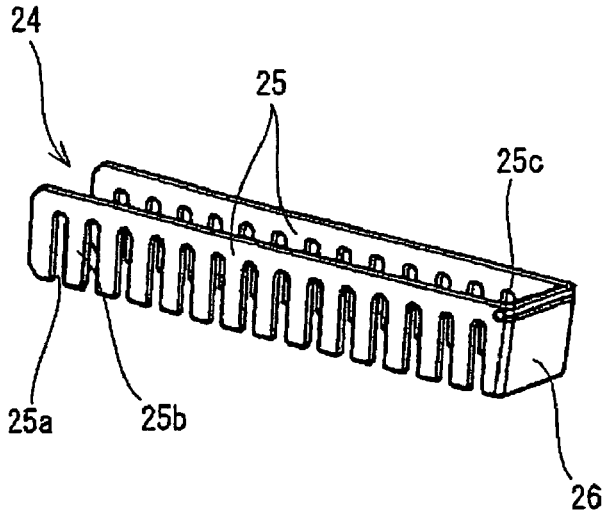
FIG. 4A is a perspective view of a shutter cover of a first embodiment of the present invention.
Figure 4B:
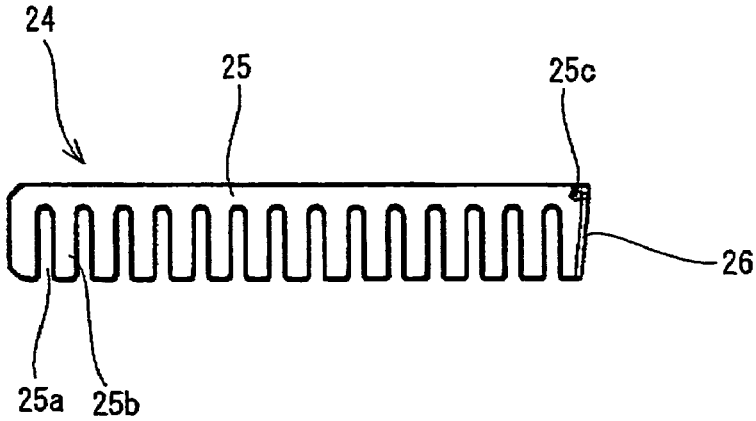
FIG. 4B is a front elevational view of shutter cover of the embodiment of FIG. 4A.
Figure 4C:
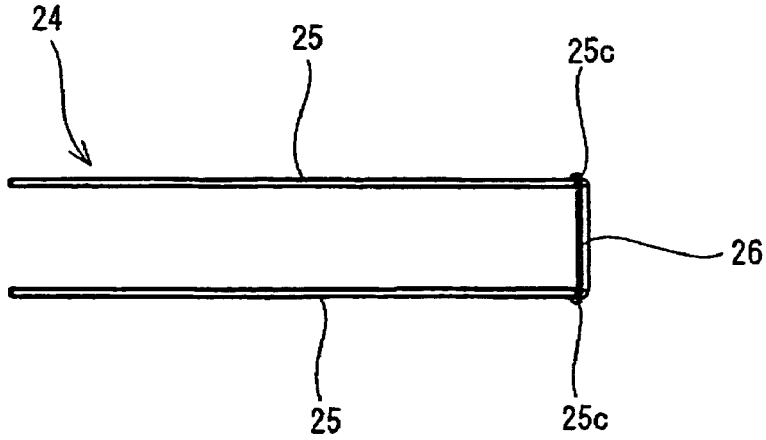
FIG. 4C is a top view of shutter cover of the embodiment of FIG. 4A.

Shutter cover 24 shown in FIG. 4A, which is attached to connector block 20, includes connecting portion 26 that joins the lengthwise ends of side members 25. Side members 25 are comb-like structures in which open portions 25*a*, which are cut inward from the bottom edge of the side members, alternate with solid portions 25*b*. The lower end of connecting portion 26 inclines inward toward side members 25. Further, stop dog or stop element 25*c* extends outward from side member 25 on the top edge adjacent to connecting portion 26.

With side members 25 of shutter cover 24 inserted into front and rear spaces 'S' in connector block 20, stop dog 25*c* is temporarily secured in disconnection holding notch 20*g* with solid portions 25*b* located directly opposite and covering slits 23 of connector block 20. Conversely, when pressure is exerted on connecting portion 26 of shutter cover 24 in space 'S', shutter cover 24 moves to a position at which it is secured by stop dog 25*c* entering connection holding notch 20*h*, thus aligning open portions 25*a* of shutter cover 24 to slits 23, and thus exposing slits 23 to the external environment.

Figure 5:
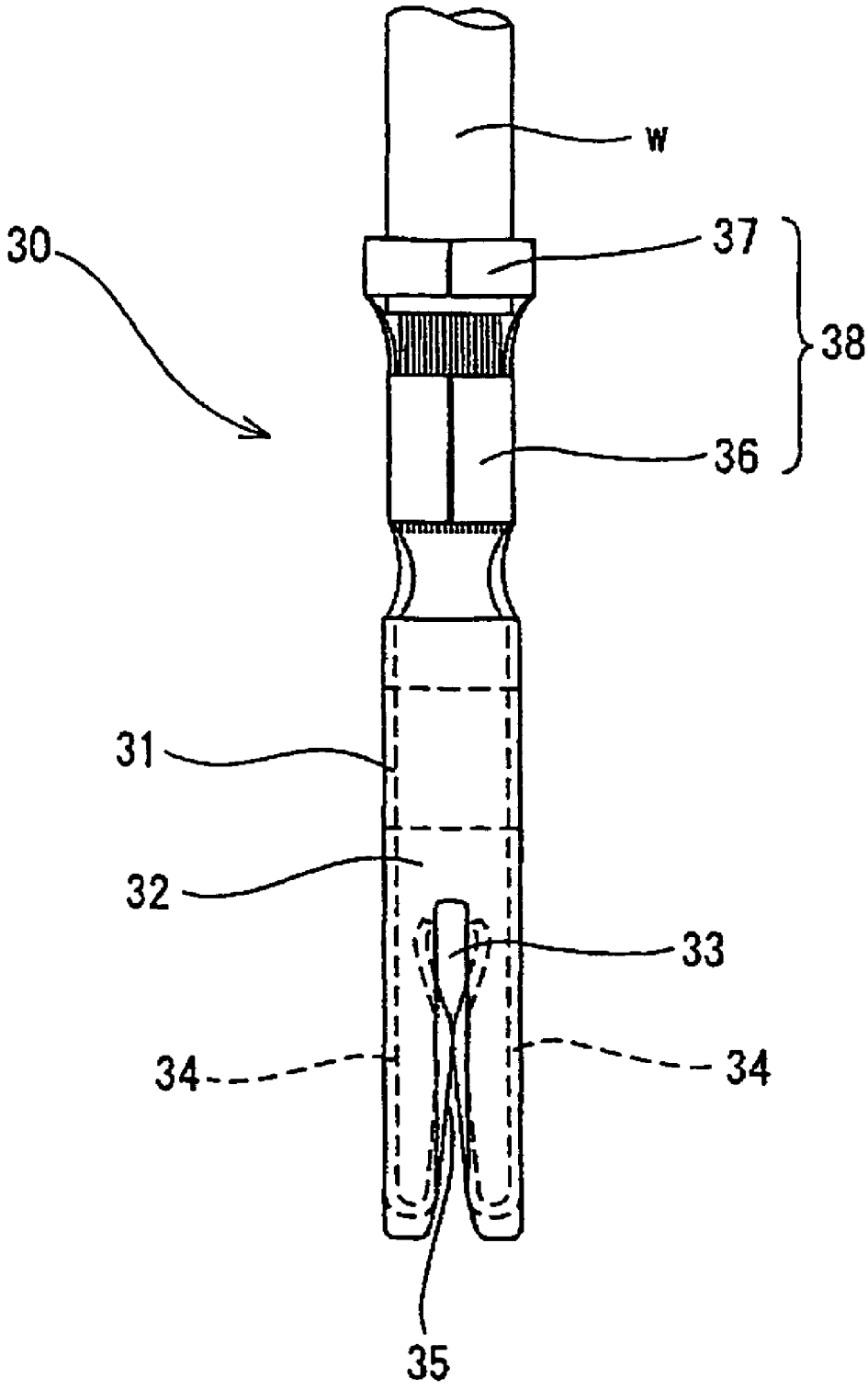
FIG. 5 is a front elevational view of the fork terminal.

Fork terminals 30, which are housed in terminal chambers 22*a* of connector block 20 include, as shown in FIG. 5, box-shaped terminal portion 31 at the front portion, and slot 33 which is formed within the front and rear sides of terminal portion 31 for insertion over a busbar. The insertion of the terminal over the busbar may require force. Also, the front portions of left and right sidewalls 34 fold back to create an inverted V-shape that forms grip portions 35 that forcefully grip busbar 40. Moreover, electrical wire crimping portion 38, which includes core wire crimping barrel 36 and insulation crimping barrel 37, is provided at the rear end of fork terminal 30.

Electrical wire 'W' is crimped within electrical wire crimping portion 38 in fork terminals 30, and fork terminal 30 is inserted and secured within terminal chamber 22 of connector block 20 with terminal portion 31 secured at the bottom edge of chamber 22 and grip portions 35 aligned with slits 23 and exposed to the external environment. Therefore, when slits 23 are covered by solid portions 25*b* on both side members 25 of shutter cover 24, grip portions 35 of fork terminals 30 are covered, thus preventing the invasion of foreign objects such as electrical wires and the like, into terminal portion 31. Further, shutter cover 24 may be attached before fork terminals 30 are inserted into terminal chambers 22 of connector block 20, or they may be attached after the insertion of fork terminals 30.

Figure 1B:
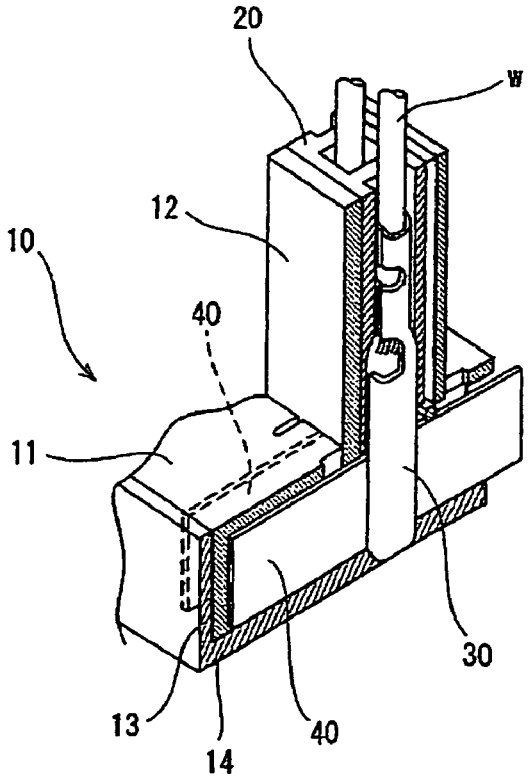
FIG. 1B is an enlarged cross sectional view of a portion of the electrical junction box of the embodiment of FIG. 1 turned 90 degrees after the connector block is inserted and illustrating the fork terminals inserted over the busbars.
Figure 2:
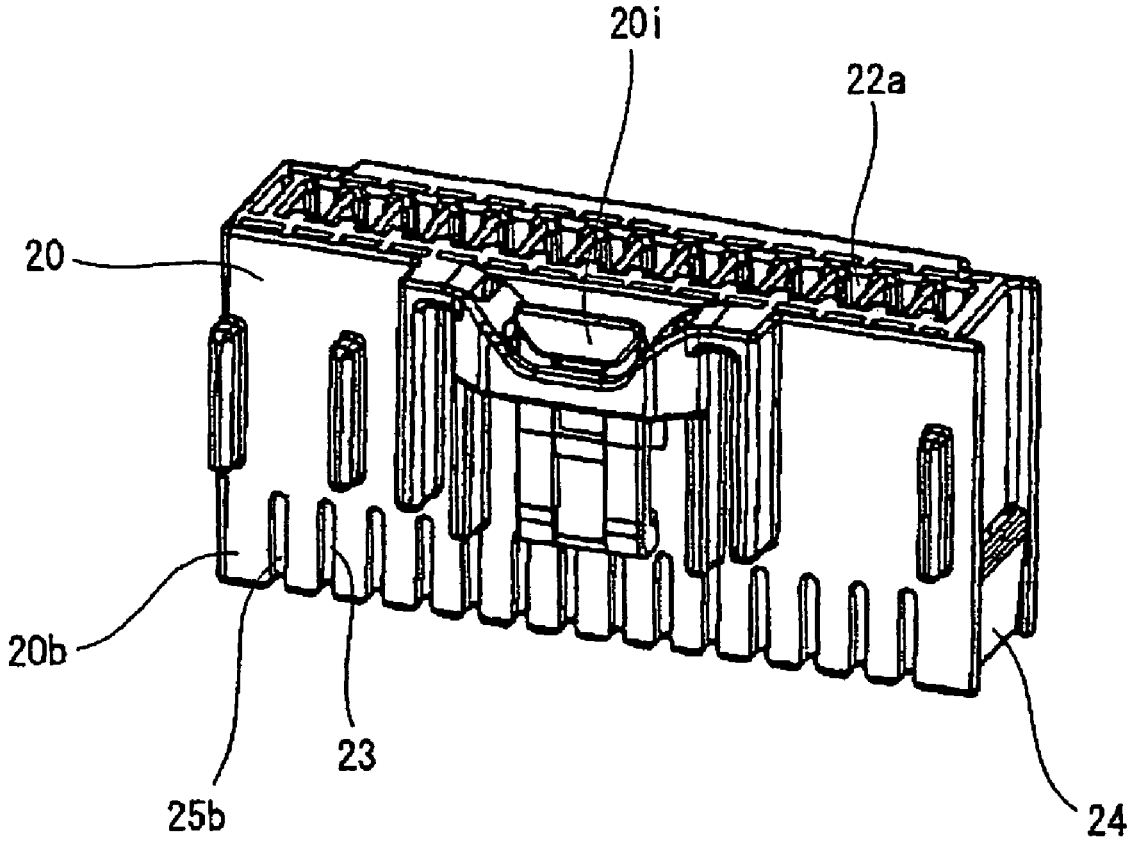
FIG. 2 is a perspective view of a shutter cover of a first embodiment of the present invention, showing the shutter cover temporarily secured to the connector block.
Figure 6A:
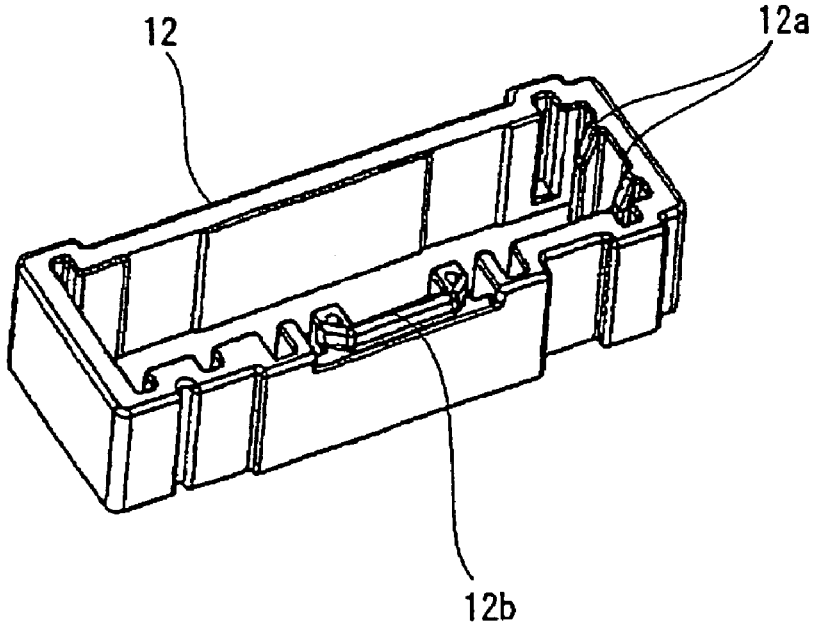
FIG. 6A is a perspective view of the connector receptacle of the case of the present invention.
Figure 6B:
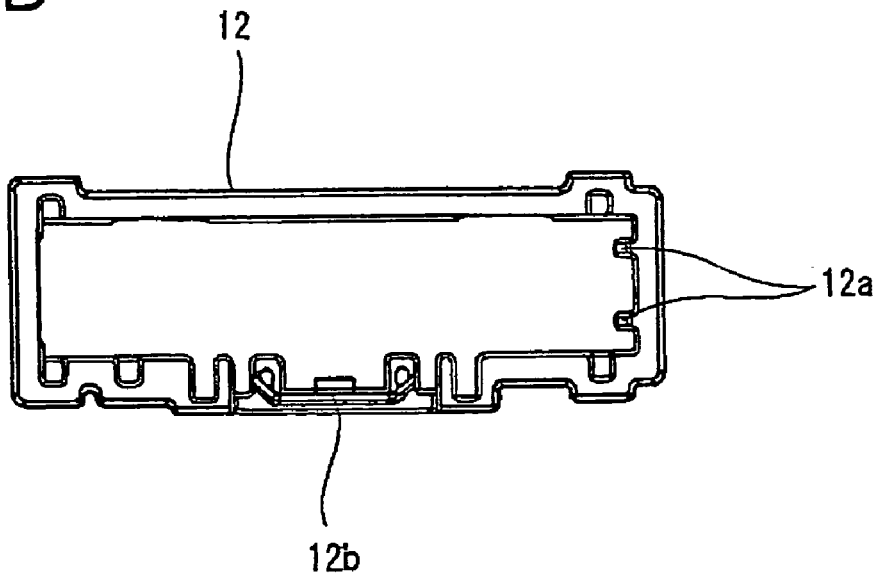
FIG. 6B is a front elevational view of the connector receptacle of the case of the present invention.

As noted previously, elongated planar busbars 40 are housed within the case which is formed from upper case 11 and lower case 13. Busbars 40 are arranged side-by-side in the Y-direction and lengthwise in the X-direction as shown in FIGS. 1A and 1B. As shown in FIG. 1A, multiple connector receptacles 12, which are provided at the top of upper case 11, are oriented lengthwise in the Y-direction across busbars 40. As shown in FIG. 6, front and rear pairs of inclined ribs 12*a* incline downward at connecting portion 26 side of shutter cover 24 which is attached to connector block 20. Locking cover portion 12*b* is provided as a joining portion to locking portion 20*i* of connector block 20. Further, inclined ribs 12*a* are not limited to a front and rear positioned pair of ribs, but may also be provided in the form of one rib located at the center of connector block 20, or in the form of three ribs.

Figure 7A:
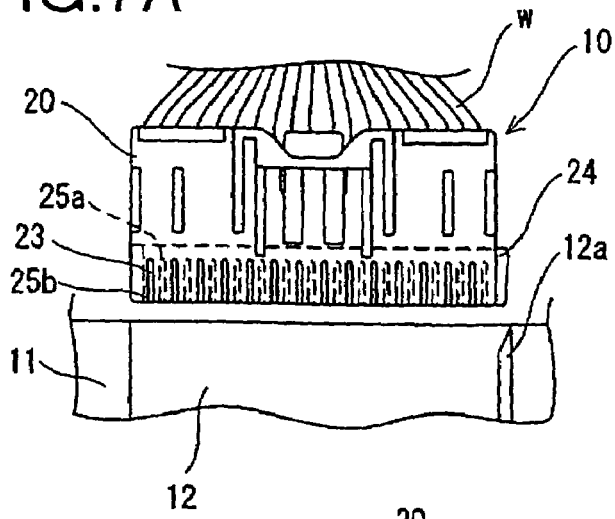
FIGS. 7A through 7D show steps to fit the connector block into the connector receptacle of the present invention.
Figure 7B:
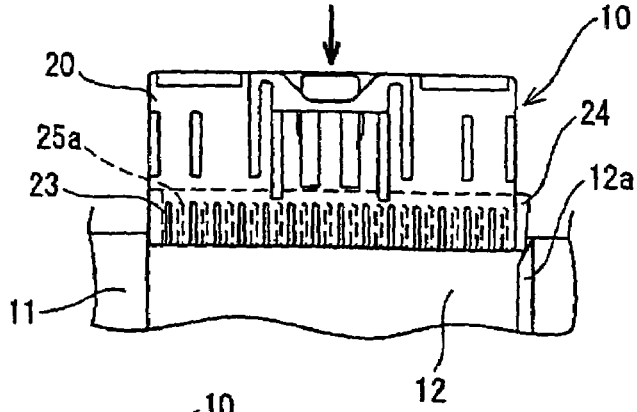
Figure 7C:
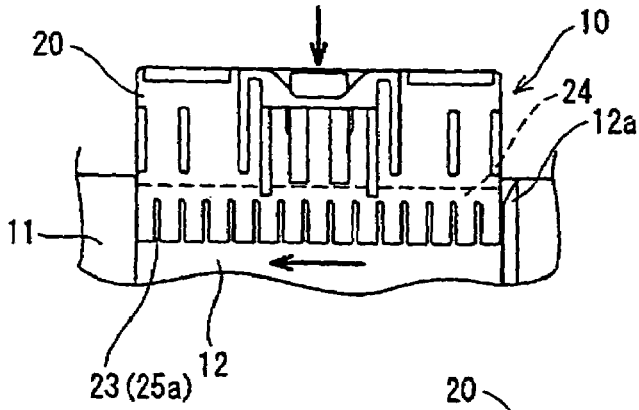
Figure 7D:
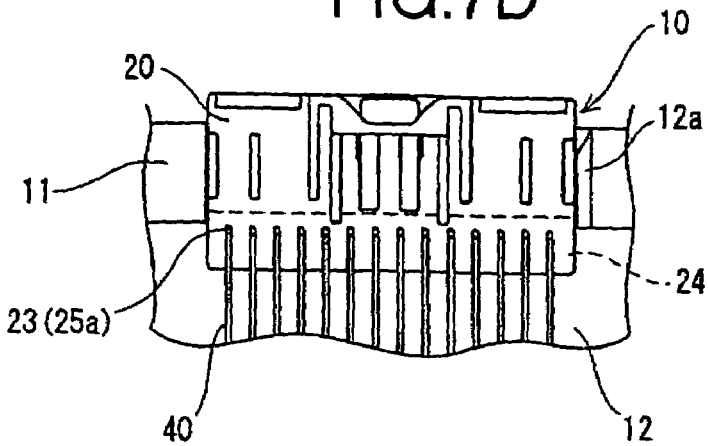
Figure 8A:
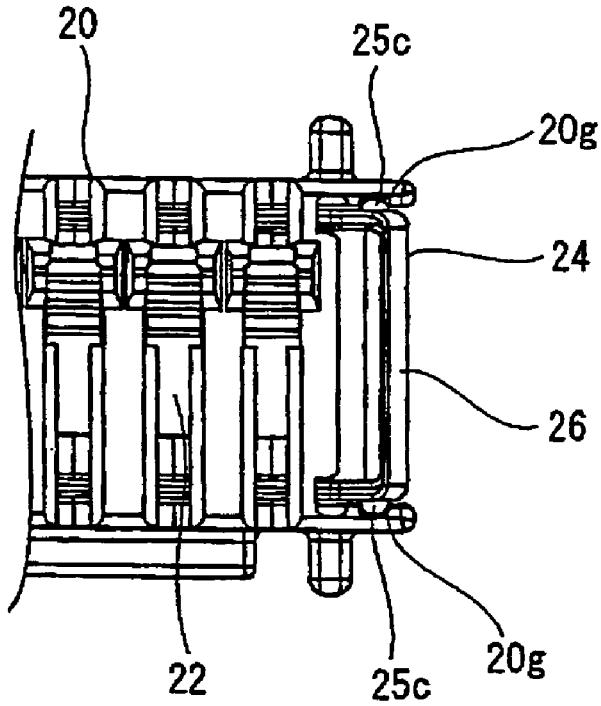
FIG. 8A shows the shutter cover temporarily secured to the connector block.
Figure 8B:
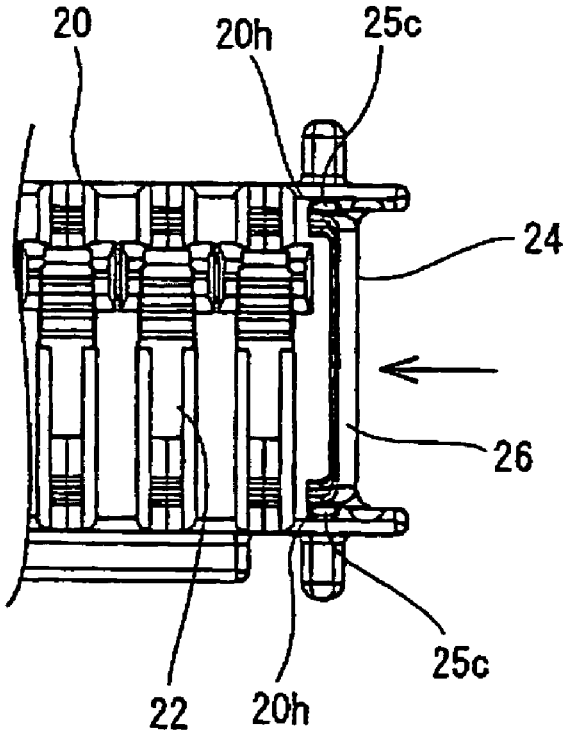
FIG. 8B shows the secured position with the connector block installed in the connector receptacle.

The following will describe the operation of the movable shutter cover 24. As shown in FIG. 7A, with fork terminals 30, to which are connected electrical wires 'W', housed within terminal chambers 22 of connector block 20, shutter cover 24 is attached to connector block 20 in a temporarily secured condition in which, as previously noted, slits 23 are covered by solid portions 25*b* of shutter cover 24. As shown in FIGS. 7B and 7C, as connector block 20 is inserted into connector receptacle 12 of case 11, inclined ribs 12*a* inside connector receptacle 12 exert pressure on connection portion 26 of shutter cover 24 which is in its temporarily secured state. Connector block 20 can be inserted smoothly into connector receptacle 12 because, as previously noted, connecting portion 26 of shutter cover 24 inclines downward toward side members 25 in approximately the same direction as inclined ribs 12*a*. Shutter cover 24 is thus able to move smoothly from its temporarily secured position to its final position corresponding to the complete insertion of connector block 20 into connector receptacle 12. As shown in FIG. 8A, stop dog 25*c*, which was previously inserted to disconnection holding notch 20*g*, is inserted into connection holding notch 20*h*, as shown in FIG. 8B, when shutter cover 24 moves to the final installed position of connector block 20 in connector receptacle 12. At this time, as shown in FIG. 7C, open portions 25*a* of shutter cover 24 align with and expose slits 23. Continued insertion of connector block 20 results in fork terminals 30 being forcefully inserted over busbars 40, through open portions 25*a* of shutter cover 24 and slits 23 of connector 20, to the extent that grip portions 35 connect to busbars 40 to form a connection there between.

This construction prevents the invasion of foreign objects into connector block 20, while connector block 20 is being inserted into connector receptacle 12 of case 11, due to slits 23 being covered by solid portions 25*b* of shutter cover 24. Therefore, grip portions 35 of fork terminals 30 are not exposed to the external environment, and the invasion of foreign objects, such as electrical wires and the like, through slits 23 and into the region between grip portions 35 of terminal portion 31, can be prevented. This structure thus prevents deformation and damage to fork terminals 30 and improves the reliability of the electrical connection.

The continued insertion of connector block 20 into connector receptacle 12 results in inclined ribs 12*a*, which project into connector receptacle 12, pressing against and moving shutter cover 24 to an extent that exposes slits 23 of connector block 20, thus eliminating the need for the operator to manually move shutter cover 24, and providing a mechanism that automatically moves the shutter cover when the connector block is inserted into the connector receptacle.

Figure 9A:
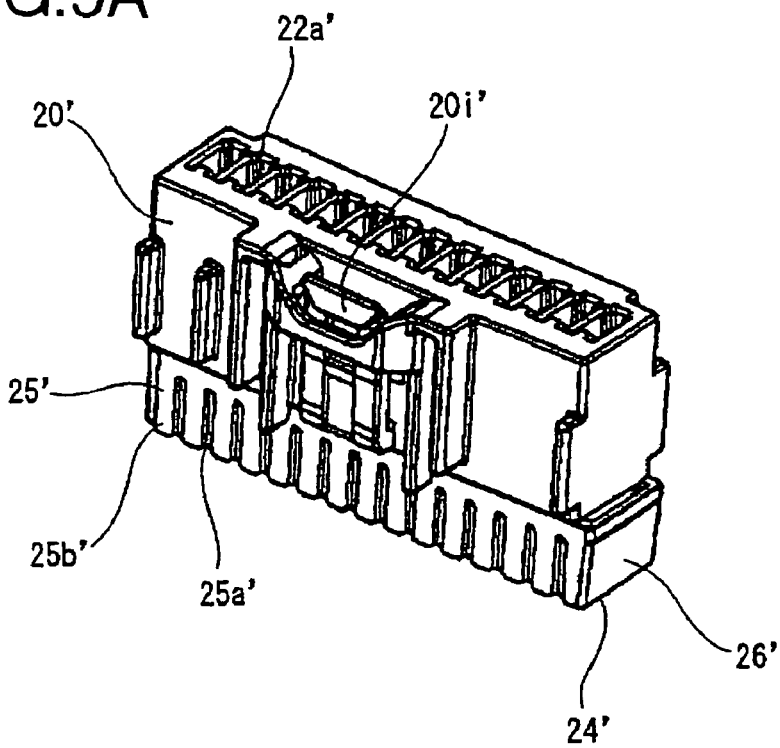
FIG. 9A is a perspective view of a shutter cover of a second embodiment of the present invention attached to the connector block, with the shutter cover in the secured position before the connector block is installed.
Figure 9B:
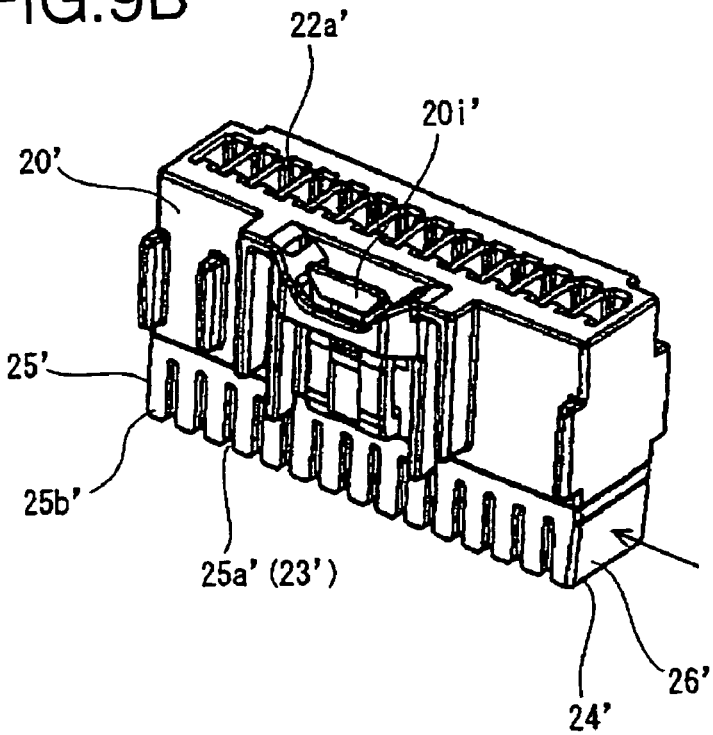
FIG. 9B is a perspective view of the shutter cover of the embodiment of FIG. 9B, with the shutter cover in the secured position after the connector block is installed.
Figure 10A:
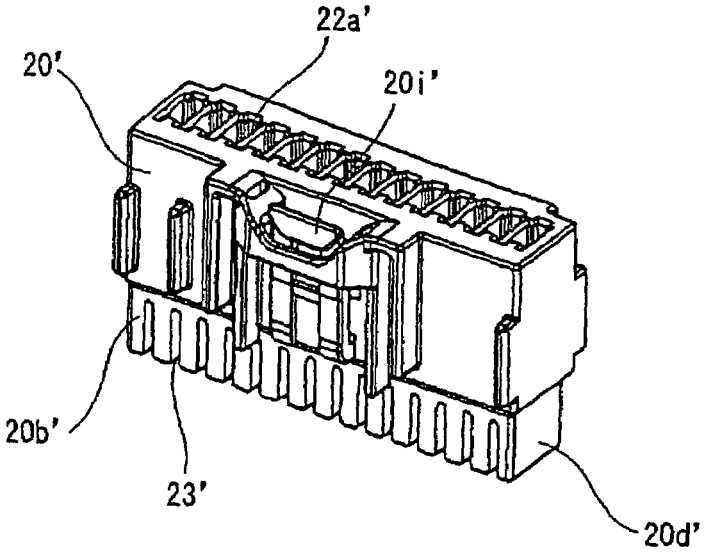
FIG. 10A is perspective view of the connector block of the embodiment of FIG. 9A.
Figure 10B:
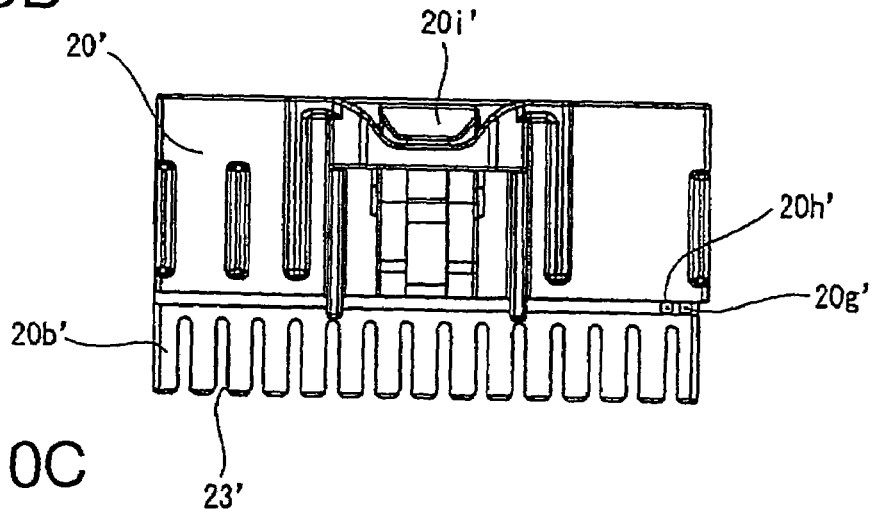
FIG. 10B is a front elevational view of the connector block of the embodiment of FIG. 9A.
Figure 10C:
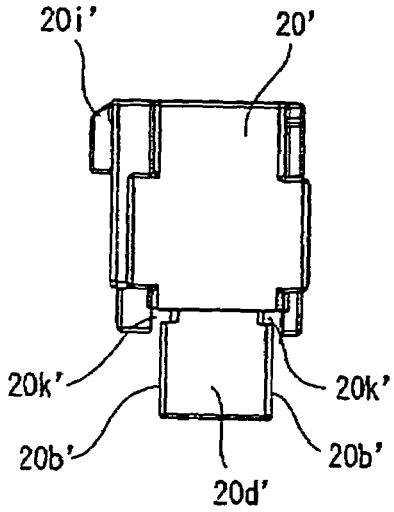
FIG. 10C is right side elevational view of the connector block of the embodiment of FIG. 9A.
Figure 11A:
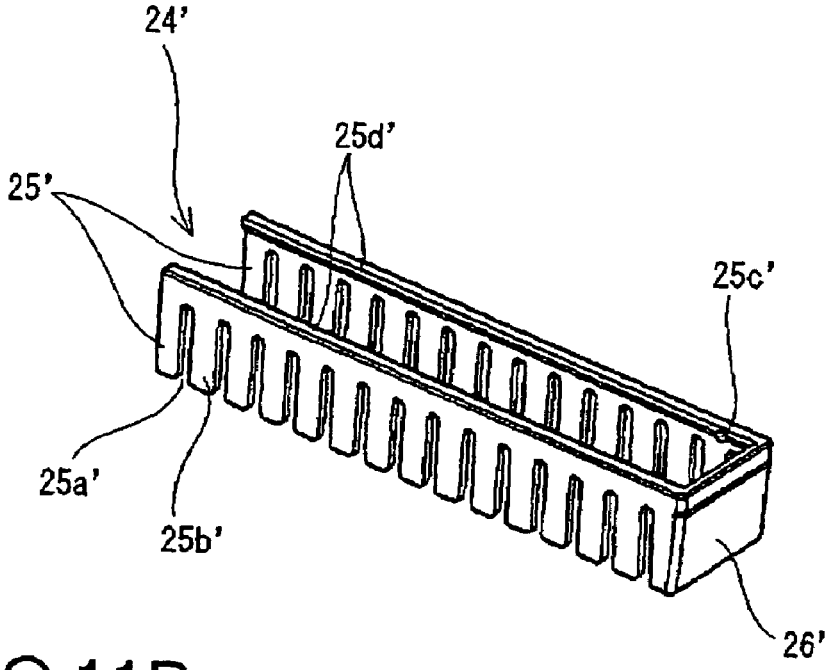
FIG. 11A is a perspective view of a shutter cover of a second embodiment of the present invention.
Figure 11B:
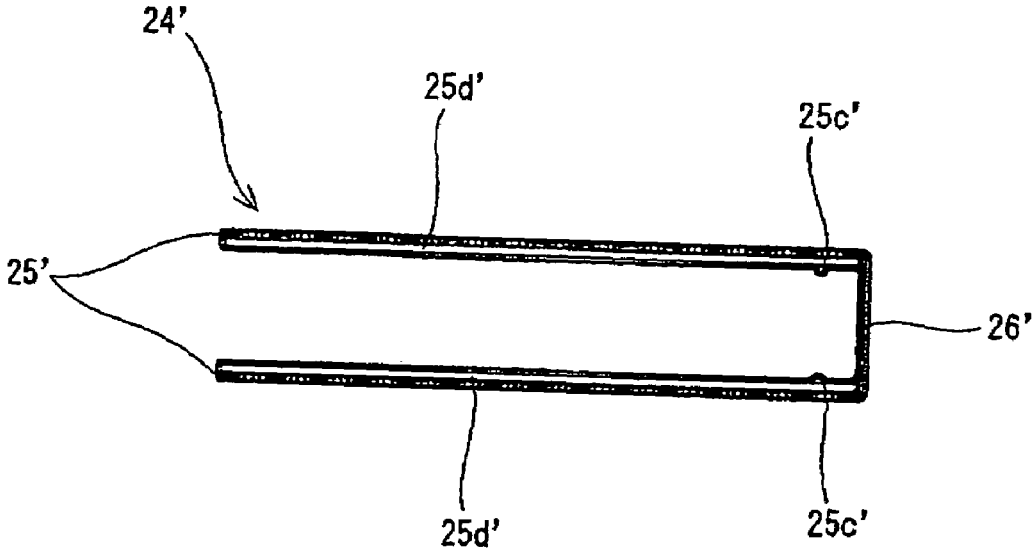
FIG. 11B is a front elevational view of the shutter cover of the embodiment of FIG. 11A.
Figure 12A:
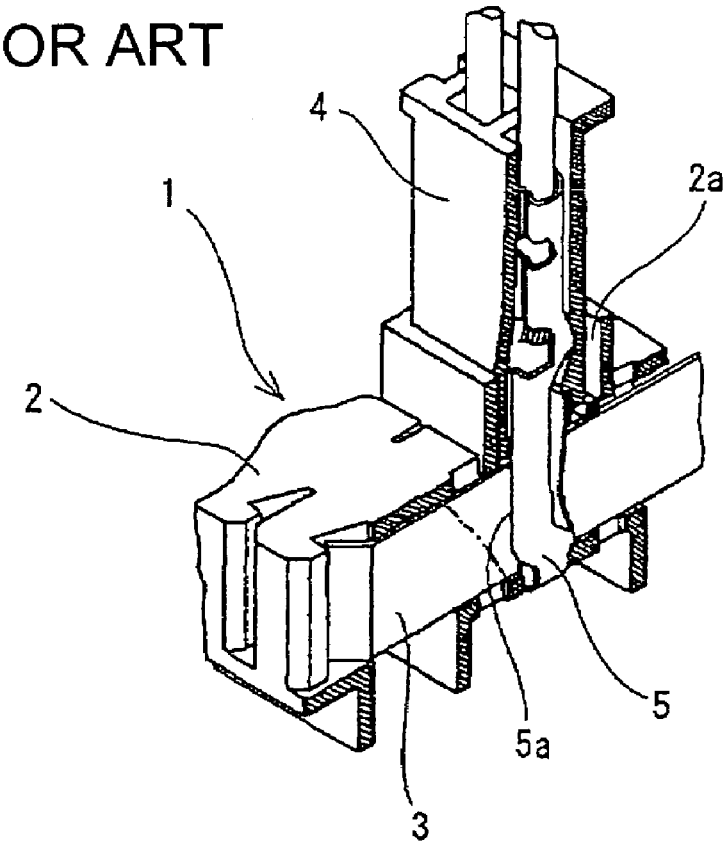
FIG.12A PRIOR ART
FIG. 12A is an enlarged partial cross sectional view of a known electrical junction box, showing the joined fork terminal and busbar.
Figure 12B:
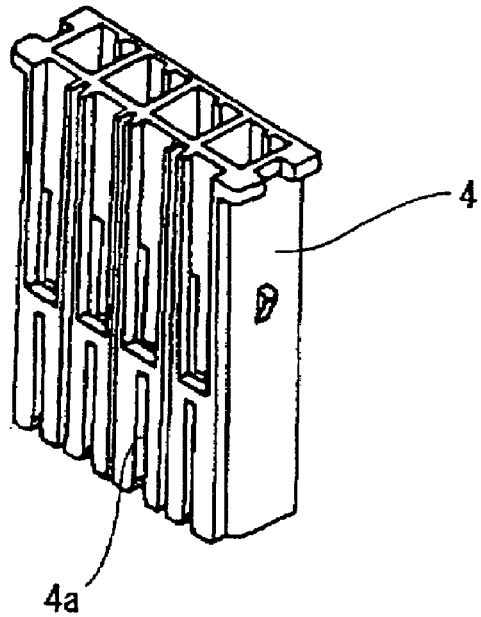
FIG.12B PRIOR ART
FIG. 12B is a perspective view of a connector block of a known electrical connection box.

FIGS. 9 through 11 illustrate a second embodiment of the invention in which shutter cover 24 is attached to external surfaces of the connector block. This is a different construction compared to that of the first embodiment in which the shutter cover is attached to internal surfaces of the connector block. As shown in FIG. 10A, the connector block 20' has the lower portion of the sidewalls formed to a narrower width than that of shutter cover 24', and provides recesses 20*k'*, as shown in FIG. 10C, from which support members 25' of shutter cover 24' are suspended in slidable contact with sidewalls 20*b'* of connector block 20'. Also, as shown in FIG. 10B, disconnection and connection holding notches 20*g'* and 20*h'*, which are formed in recesses 20*k'* at right sidewall 20*d'* where shutter cover 24' is inserted, are provided to secure shutter cover 24'. Disconnection holding notch 20*g'* is formed toward the external side of connecting block 20', and connection holding notch 20*h'* is formed inward of disconnection holding notch at the required distance therefrom.

Shutter cover 24', as shown in FIGS. 11A and 1B, has a construction similar to that of the first embodiment, shutter cover 24' being provided with connecting portion 26' that connects one end of both side members 25' which have a comb-like structure in which open portions 25*a'*, which are cut inward from the bottom edge, alternate with solid portions 25*b'*. Further, the top edges of both side members 25' extend inward to form mounting lip 25*d'* which is inserted into recesses 20*k'*. Stop dog 25*c'* projects inward from mounting lip 25*d'* near connecting portion 26'.

As shown in FIG. 9A, when mounting lip 25*d'* on both side members 25' of shutter cover 24' is inserted into recesses 20*k'* of connector block 20', stop dog 25*c'* is temporarily secured within disconnection notch 20*g'*, and both side members 25' of shutter cover 24' are in slidable contact with the external surface of side walls 20*b'* of connector block 20'. With shutter cover 24' in this position, solid portions 25*b'* are located opposite corresponding slits 23' of connector block 20', and thus cover slits 23'. When connector block 20' is inserted into connector receptacle 12 of upper case 11, inclined ribs 12*a*, which are located within connector receptacle 12, forcefully press against connecting portion 26' of shutter cover 24', and thus displace shutter cover 24' to a position where stop dog 25*c* enters connected notch 20*h'*, as shown in FIG. 9B. Open portions 25*a'* of shutter cover 24' align with and expose slits 23', thus allowing fork terminals 30 (within connector block 20') to forcefully fit over busbars 40.

As previously described, the second embodiment construction, which has shutter cover 24' attached to the external side of connector block 20', provides at least the same advantages of the first embodiment construction. That is, shutter 24' is able to keep slits 23' covered while connector block 20' is being inserted into connector receptacle 12 of upper case 11, and thus prevents the invasion of foreign objects between the tines of fork terminals 30.

Descriptions of structures and operations of the second embodiment that are essentially similar to those of the first embodiment have been omitted. Element numbers of similar components used by both embodiments are the same.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2003-310316, filed on Sep. 2, 2003, which is herein expressly incorporated by reference in its entirety.

What is claimed is:

1. An electrical junction box comprising:

a plurality of planar busbars aligned in parallel within a case;

a connector receptacle extending across said aligned busbars in said case;

a connector block including slits formed at intervals along sidewalls thereof, said connector block configured to fit into said connector receptacle;

a plurality of fork shaped terminals connected to ends of electrical wires, said fork shaped terminals secured within terminal chambers in said connector block, said fork shaped terminals fitting over said busbars when said connector block is inserted into said connector receptacle; and a shutter cover configured to expose or cover said slits of said connector block, and said shutter cover is attached to a portion of said connector block where said slits are provided.

2. The electrical junction box according to claim 1, wherein said shutter cover is movable between a position covering said slits of said connector block and a position exposing said slits of said connector block.

3. The electrical junction box according to claim 1, wherein said shutter cover is configured in a comb like construction with alternating open and solid portions on side members thereof and a connecting portion that joins an end of each side member.

4. The electrical junction box according to claim 3, wherein said shutter cover being movable between a position in which said slits of said connector block are covered by said solid portion of said shutter cover and a position aligning said open portions of said shutter cover with said slits so that said busbars may enter said slits without obstruction when said connector block is inserted into said connector receptacle of said case.

5. The electrical junction box according to claim 3, wherein each comb like side member of said shutter cover is provided in sliding contact with inside surfaces of said connector block sidewalls;

said connecting portion is exposed as an external surface with said shutter cover temporarily secured to said connector block; and said connector receptacle including inclined ribs projecting therein and configured to exert pressure on said connecting portion to move said shutter cover to a position aligning said open portions of said shutter cover with said slits when said connector block is inserted into said connector receptacle.

6. The electrical junction box according to claim 3, wherein each comb like side member of said shutter cover is provided in sliding contact with outside surfaces of said connector block sidewalls;

said connecting portion is exposed as an external surface with said shutter cover temporarily secured to said connector block; and said connector receptacle including inclined ribs projecting therein and configured to exert pressure on said connecting portion to move said shutter cover to a position aligning said open portions of said shutter cover with said slits when said connector block is inserted into said connector receptacle.

7. A connector block comprising:

slits formed at intervals along sidewalls thereof, and configured to fit into a connector receptacle on an electrical junction box;

a plurality of fork shaped terminals connected to ends of electrical wires, said fork shaped terminals secured within terminal chambers in the connector block, said fork shaped terminals fitting over busbars in the electrical junction box when said connector block is inserted into said connector receptacle; and a shutter cover configured to expose or cover said slits of said connector block, and said shutter cover is attached to a portion of said connector block where said slits are provided.

8. The connector block according to claim 7, wherein said shutter cover is movable between a position covering said slits of said connector block and a position exposing said slits of said connector block.

9. The connector block according to claim 7, wherein said shutter cover is configured in a comb like construction with alternating open and solid portions on side members thereof and a connecting portion that joins an end of each side member.

10. The connector block according to claim 9, wherein said shutter cover movable between a position in which said slits of said connector block are covered by said solid portion of said shutter cover and a position aligning said open portions of said shutter cover with said slits so that busbars may enter said slits without obstruction when said connector block is inserted into said connector receptacle.

11. The connector block according to claim 9, wherein each comb like side member of said shutter cover is provided, in sliding contact with inside surfaces of said connector block sidewalls;

said connecting portion is exposed as an external surface with said shutter cover temporarily secured to said connector block to cooperate with inclined ribs projecting in said connector receptacle, the inclined ribs configured to exert pressure on said connecting portion to move said shutter cover to a position aligning said open portions of said shutter cover with said slits when said connector block is inserted into said connector receptacle.

12. The connector block according to claim 9, wherein each comb like side member of said shutter cover is provided in sliding contact with outside surfaces of said connector block sidewalls;

said connecting portion is exposed as an external surface with said shutter cover temporarily secured to said connector block to cooperate with inclined ribs projecting in said connector receptacle, the inclined ribs configured to exert pressure on said connecting portion to move said shutter cover to a position aligning said open portions of said shutter cover with said slits when said connector block is inserted into said connector receptacle.

* * * * *